US009191747B2

(12) United States Patent
Dodd

(10) Patent No.: US 9,191,747 B2
(45) Date of Patent: Nov. 17, 2015

(54) LOUDSPEAKER WITH FORCE CANCELLING CONFIGURATION

(75) Inventor: Mark Alexander Dodd, Woodbridge (GB)

(73) Assignee: GP Acoustics (UK) Limited, Maidstone (GB)

( * ) Notice: Subject to any disclaimer, the term of this patent is extended or adjusted under 35 U.S.C. 154(b) by 211 days.

(21) Appl. No.: 14/117,290

(22) PCT Filed: May 18, 2012

(86) PCT No.: PCT/GB2012/000448

§ 371 (c)(1), (2), (4) Date: Nov. 12, 2013

(87) PCT Pub. No.: WO2012/156675

PCT Pub. Date: Nov. 22, 2012

(65) Prior Publication Data

US 2014/0211963 A1 Jul. 31, 2014

(30) Foreign Application Priority Data

May 18, 2011 (GB) ..... 1108333.4

(51) Int. Cl.

| | |
|---|---|
| ***H04R 9/06*** | (2006.01) |
| ***H04R 7/12*** | (2006.01) |
| *H04R 1/28* | (2006.01) |
| *H04R 7/04* | (2006.01) |

(52) U.S. Cl.

CPC ..... *H04R 9/063* (2013.01); *H04R 1/2896* (2013.01); *H04R 7/12* (2013.01); *H04R 1/288* (2013.01); *H04R 7/04* (2013.01); *H04R 2209/027* (2013.01)

(58) Field of Classification Search

CPC ..... H04R 1/28; H04R 1/40

See application file for complete search history.

(56) References Cited

U.S. PATENT DOCUMENTS

| | | | | |
|---|---|---|---|---|
| 3,393,764 | A | 7/1968 | Schafer | |
| 4,783,820 | A | 11/1988 | Lyngdorf et al. | |
| 4,805,221 | A | 2/1989 | Quaas | |
| 6,678,384 | B2 * | 1/2004 | Kowaki et al. | 381/182 |
| 7,062,054 | B2 * | 6/2006 | Nishikawa et al. | 381/182 |
| 2006/0002569 | A1 | 1/2006 | Dickie | |

FOREIGN PATENT DOCUMENTS

| | | | |
|---|---|---|---|
| EP | 0459682 | A2 | 12/1991 |
| EP | 0917396 | A2 | 5/1999 |
| EP | 1162864 | A2 | 12/2001 |
| EP | 1370110 | A1 | 12/2003 |
| GB | 2414620 | A | 11/2005 |
| WO | 03034778 | A2 | 4/2003 |

OTHER PUBLICATIONS

International Preliminary Report on Patentability for PCT/GB2012/000448, filed May 18, 2012.

Great Brittan Examination Report. Application No. GB1108333.4. Aug. 15, 2013.

Great Brittan Search Report. Application No. GB1108333.4. Jun. 7, 2011.

International Search Report and Written Opinion; PCT/GB2012/000448. Sep. 10, 2012.

* cited by examiner

*Primary Examiner* — Simon Sing

(74) *Attorney, Agent, or Firm* — Westman, Champlin & Koehler, P.A.

(57) ABSTRACT

The present invention provides a loudspeaker with at least two diaphragm assemblies, in which the reactive forces acting on the magnets in each assembly cancel. By linking the two magnets together via a non-rigid material, resonance in the drive assemblies is highly damped and corresponding distortion of the loudspeaker output is reduced.

18 Claims, 2 Drawing Sheets

LOUDSPEAKER WITH FORCE CANCELLING CONFIGURATION

CROSS-REFERENCE TO RELATED APPLICATION

This Application is a Section 371 National Stage Application of International Application No. PCT/GB2012/000448, filed May 18, 2012 and published as WO/2012/156675 A1 on Nov. 22, 2012, in English, which claims priority to and benefits of British Patent Application No. 1108333.4, filed May 18, 2011, the contents of which are hereby incorporated by reference in their entirety.

FIELD OF THE INVENTION

The present invention relates to loudspeakers.

BACKGROUND ART

The structure and operation of moving coil loudspeaker drive units is well known. A vibration diaphragm is attached to a coil of wire known as a voice coil, and the voice coil is placed in a magnetic field usually provided by one or more permanent magnets. By passing an alternating current through the voice coil, a force is induced and the diaphragm can be made to vibrate and so radiate acoustic waves.

What is sometimes not appreciated is that the force induced in the voice coil also gives rise to an unintentional reactive force on the motor system, following Newton's third law of motion. The mechanical vibration resulting from the reactive force on the motor is transmitted via the driver chassis and can excite the walls of a loudspeaker enclosure; in many loudspeaker systems this form of excitation is the major cause of motion in the enclosure walls. Since the walls have large area and exhibit structural resonances they can radiate significant sound resulting in a tonally distorted output from the loudspeaker.

Various solutions have been proposed to avoid this magnet vibration. U.S. Pat. No. 4,805,221 is one of several which disclose a loudspeaker with two substantially identical diaphragms and drive assemblies, mounted back to back. The permanent magnets of each assembly are rigidly coupled together by tie bars such that any reactive force in one magnet is cancelled by the opposing reactive force in the other. In this way magnet vibration is reduced along with the corresponding sound radiation from the enclosure walls. UK patent application no 0411566.3 (publication no 2414620) discloses a development of this design, in which the tie bar has an adjustable length.

The present inventors have carried out laser vibrometry measurements of a loudspeaker according to the design of U.S. Pat. No. 4,805,221, and found that at frequencies of above a few hundred Hertz the forces on the drivers do not cancel due to the excitation of structural modes of resonance in the tie bars. An alternative solution is therefore required.

SUMMARY OF THE INVENTION

The present invention provides a loudspeaker, comprising: a first diaphragm and a respective first drive assembly, the first drive assembly comprising at least a first magnet; a second diaphragm and a respective second drive assembly, the second drive assembly comprising at least a second magnet; and a coupling member connecting the first magnet to the second magnet, said coupling member being or comprising a non-rigid material arranged such that alternating forces are conveyed from the first magnet to the second magnet and vice versa, and magnet vibrations are reduced.

In embodiments of the present invention, the non-rigid material may have viscous, visco-elastic or adhesive properties. For example, if adhesive, the non-rigid material may provide a clamping force F between the first and second magnets of:

$$F>2IBl$$

where I is the current flowing in a voice coil of the first or second drive assembly, and Bl is the force generated by 1 ampere of current flowing through the voice coil of the first or second drive assembly (known in the industry as the "force factor").

In embodiments of the present invention, the viscosity of the non-rigid material may mean that it is unable to hold its shape. In that case, an elastic member may be used to ensure the non-rigid material is retained in the correct position.

Suitable non-rigid materials are Blu Tack®, mastic, putty or butyl mastic.

In embodiments of the present invention, the first and second diaphragms and the first and second drive assemblies are substantially identical. The first and second drive assemblies may also be mounted and wired such that the forces acting on the magnets substantially cancel.

In yet further embodiments of the present invention, the diaphragm assemblies and the coupling member have dimensions resulting in resonance coinciding with at least one resonant frequency of the drive assembly. In order to reduce the magnet resonance at this frequency, in one embodiment the coupling member has a Q factor of less than 5, and may have a Q factor of less than 0.5 at the resonant frequency.

Embodiments of the present invention are believed to be particularly advantageous in loudspeakers with wooden boxes, in which resonance is a particular problem and manufacturing tolerances could otherwise result in tension/compression in the coupling member.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
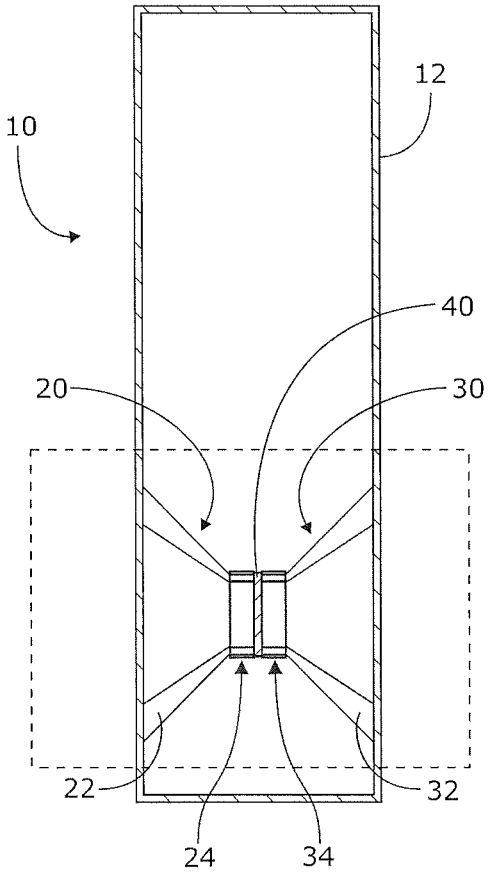
FIG. 1 shows a loudspeaker according to embodiments of the present invention.
Figure 2:
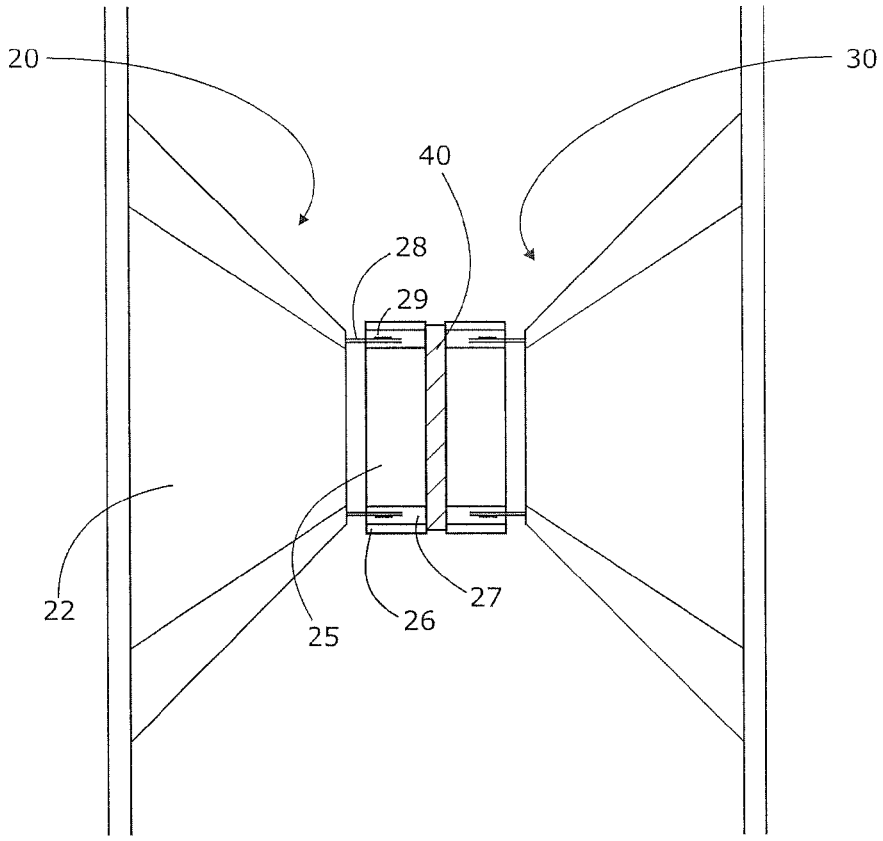
FIG. 2 shows in more detail the dashed box in FIG. 1 in cross-section.

FIG. 1 shows a loudspeaker 10 according to embodiments of the present invention. FIG. 2 shows more detail in cross-section of the dashed box in FIG. 1.

The loudspeaker generally comprises a wooden or plastic box or enclosure 12, in which two diaphragm assemblies 20, 30 are mounted back to back. In the illustrated embodiment, the diaphragm assemblies are mounted directly on the box 12 without a metallic linking structure. The diaphragm assemblies are substantially identical, and in the illustrated embodiment comprise a conical diaphragm 22, 32 as will be familiar to those skilled in the art. However, many alternative shapes of diaphragm are known and the present invention is not limited to any particular shape or design. For example, each diaphragm may have a planar front surface in order to reduce the overall depth of the driver as compared to cone-shaped diaphragms.

Each diaphragm 22, 32 is coupled to a respective drive assembly, which can be viewed in more detail in FIG. 2 (for clarity, FIG. 2 includes reference numerals for only one of the assemblies). The drive assemblies themselves are largely conventional. A permanent magnet 24, 34 has a central pole piece 25 and a cylindrical outer pole piece 26 to define a magnetic field gap 27. At the throat of each diaphragm 20, 30, a voice coil 29 is supported on a cylindrical voice coil former 28 so as to lie at least partly within the magnetic field gap 27. The voice coil former 28 drives the diaphragm 20 to which it is attached and thus, by passing a suitable alternating current through the voice coil, an axial force can be induced in the diaphragm which causes acoustic waves to be generated; of course, a corresponding reactive force is also experienced by the magnet.

Each diaphragm assembly is mounted "back to back". That is, the two diaphragm assemblies are substantially aligned axially with one another and such that the diaphragms project in substantially opposite directions. It will be noted by those skilled in the art that it is also possible to link more than two diaphragm assemblies in this way. Any number of diaphragm assemblies can be linked symmetrically about a single axis of symmetry such that the forces acting on the respective magnets cancel, and the present invention is not limited to the case of two diaphragm assemblies.

It is an object of the present invention to reduce or minimize the impact of reactive forces on the permanent magnets 24, 34. Such a reactive force has been known to cause magnet vibrations resulting in vibration in the loudspeaker box 12. Due to structural resonances these magnet vibrations can lead to significant output of unwanted sound. In order to solve this problem, it is known to physically link the two permanent magnets together, and to drive the two diaphragm assemblies by the same electrical signal. The voice coils are wired oppositely, so the reactive forces acting on the permanent magnets are simultaneous, equal and opposite. In this way, the forces should cancel out avoiding magnet vibration. However, the present inventors have found that known linkages (where the linkage is rigid) can themselves lead to structural resonances at high frequencies. At these frequencies, the reactive forces do not cancel out and once again significant sound is output from the speaker box 12.

In addition, the distance between the mounting surface of the drivers may not match the distance between the mounting surface on the enclosure 12 due to tolerance build up. This can result in compression/tension in the linkage between the magnets. When the diaphragm assemblies are supported only by a wooden enclosure the problem is exacerbated, and either the box will be deformed and break or the magnets will not make intimate contact.

In order to solve these problems, according to embodiments of the present invention the two magnets 24, 34 are connected together via a coupling member 40 comprising a non-rigid material interdisposed between the two magnets. Indeed, in the illustrated embodiment the coupling member 40 consists of the non-rigid material solely. The nature of the material is such that an alternating force applied to one magnet is felt equally by the other magnet, but that vibrations caused by resonance are damped. For example, the non-rigid material may have a high level of viscosity at room temperature (298 K), to transfer the forces between the magnets and yet provide the necessary level of acoustic damping. Examples of materials which provide the necessary properties are: Blu-Tack®, mastic, putty or butyl mastic, specifically 3M Scotch-Seal 2229 Mastic. These materials undergo flowing deformation with static force and thus the coupling member thickness reduces to minimise the static force, while having sufficient mechanical impedance at audio frequencies to convey the alternating forces. The coupling member effectively dampens vibrational energy by reducing the amplitude of magnet resonance.

The non-rigid material may also have elastic properties (i.e. making it visco-elastic). This allows the material to retain its own shape for a continuous period of time, and allows the coupling member 40 to comprise substantially only the visco-elastic material. One suitable visco-elastic material is that marketed under the brand name Blu-Tack® at the time of filing this application. In this case the elastic properties may increase the frequency of magnet resonance as well as introduce significant damping.

In the illustrated embodiment, the coupling member 40 is formed in a flat disc, with the plane of the disc running transverse to the axis of the diaphragms 22, 32. The disc may take any shape (although a circular cross-section is the most practical arrangement). The thickness of the coupler should be greater than the total tolerance build up between magnets to avoid mechanical interference and ensure intimate contact. The coupler area should be as large as possible to provide the highest mechanical impedance. Of course, alternative arrangements can be employed without departing from the scope of the invention. The non-rigid material may be placed in direct contact with the permanent magnets 24, 34, or may couple the magnets together via an intermediate material. In one embodiment, the linkage is such that all paths between the two magnets run through the non-rigid material. That is, vibrational energy passed from one magnet to the other magnet must pass through the non-rigid material. In this case the non-rigid material may also be adhesive, to maintain the necessary contact between the respective magnets 25. The clamping force F provided by the non-rigid, adhesive material may be described by $$F>2IBl,$$

where I is the current flowing in a voice coil of the first or second drive assembly, and Bl is the force generated by 1 ampere of current flowing through the voice coil of the first or second drive assembly (known in the industry as the "force factor"). Provided F is greater than $2I_{max}Bl$, where $I_{max}$ is the maximum current flowing in the voice coils, the two magnets will not come apart. Use of a non-adhesive material may be allowed by a layer of adhesive between the coupler and magnets.

A particular problem in loudspeakers is the phenomenon of magnet resonance. The diaphragm assemblies and the coupling member have dimensions so as to result in magnet resonance at at least one resonant frequency. If the magnet resonance is in the frequency range where the drivers are producing the main acoustic output the coupler should preferably achieve a low Q such as 0.5 to mitigate the impact of the resonance on the sound radiation of the enclosure walls. Should the frequency of the magnet resonances be above the frequency range where the drivers are producing the main acoustic output a higher Q of say 5 may allow satisfactory results.

Figure 3:
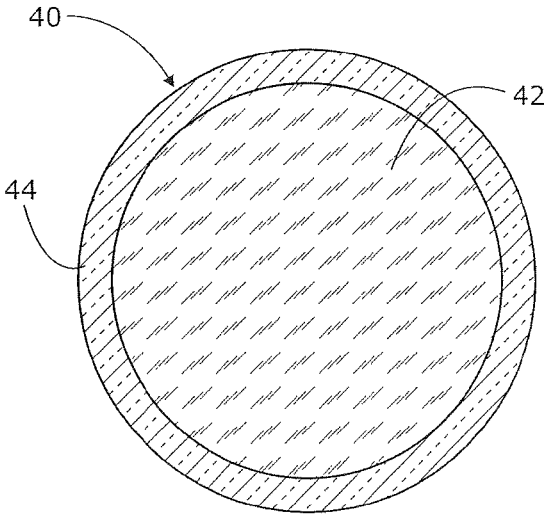
FIG. 3 shows a disc of viscous material according to embodiments of the present invention.

The coupling member according to one embodiment is shown in more detail in FIG. 3. In the illustrated embodiment, the non-rigid, viscous material 42 (i.e. not having elastic properties) is shaped into a disc, and held in shape by a visco-elastic ring 44. The non-rigid, viscous material 42 has no elastic properties and so provides no or little restoring force when undergoing compression or tension due to relative movement of the magnets 24, 34. Resonance and vibrations are highly damped.

The present invention therefore provides a loudspeaker with at least two diaphragm assemblies, in which the reactive forces acting on the magnets in each assembly cancel. By linking the two magnets together via a non-rigid material, magnet resonance is highly damped and corresponding distortion of the loudspeaker output is reduced.

It will of course be understood that many variations may be made to the above-described embodiment without departing from the scope of the present invention.

The invention claimed is:

1. A loudspeaker, comprising:

a first diaphragm and a respective first drive assembly, the first drive assembly comprising at least a first magnet;

a second diaphragm and a respective second drive assembly, the second drive assembly comprising at least a second magnet; and a coupling member connecting the first magnet to the second magnet, said coupling member comprising a non-rigid material arranged such that forces are conveyed from the first magnet to the second magnet and vice versa, but that vibrations in the coupling member are damped.

2. The loudspeaker according to claim 1, wherein the first and second drive assemblies and the coupling member have dimensions so as to result in resonance at a resonant frequency.

3. The loudspeaker according to claim 2, wherein the non-rigid material is a visco-elastic material.

4. The loudspeaker according to claim 2, wherein the addition of the coupling member results in a system Q factor of less than 5 at said resonant frequency.

5. The loudspeaker according to claim 4, wherein the non-rigid material is a visco-elastic material.

6. The loudspeaker according to claim 4, wherein the addition of the coupling member results in a system Q factor of less than 0.5 at said resonant frequency.

7. The loudspeaker according to claim 6, wherein the non-rigid material is a visco-elastic material.

8. The loudspeaker according to claim 1, wherein the non-rigid material is a viscous material.

9. The loudspeaker according to claim 8, wherein the viscous material is retained in its position by a visco-elastic member.

10. The loudspeaker according to claim 1, wherein the non-rigid material is a visco-elastic material.

11. The loudspeaker according to claim 1, wherein the non-rigid material is adhesive.

12. The loudspeaker according to claim 11, wherein the non-rigid material provides a clamping force F between the first and second magnets of:

$$F>2IBl$$

where I is the current flowing in a voice coil of the first or second drive assembly, and Bl is the force generated by 1 ampere of current flowing through the voice coil.

13. The loudspeaker according to claim 1, wherein the non-rigid material comprises Blu Tack®, mastic, putty or butyl mastic.

14. The loudspeaker according to claim 1, wherein the non-rigid material is formed into a disc.

15. The loudspeaker according to claim 1, further comprising a box in which the first and second diaphragms and the first and second drive assemblies are mounted.

16. The loudspeaker according to claim 15, wherein the box is wooden or plastic.

17. The loudspeaker according to claim 1, wherein the first and second diaphragms and the first and second drive assemblies are substantially identical.

18. The loudspeaker according to claim 1, wherein the first and second drive assemblies are mounted and wired such that the forces acting on the magnets substantially cancel.

* * * * *